US005485640A

United States Patent [19]

Workman

[11] Patent Number: 5,485,640

[45] Date of Patent: Jan. 23, 1996

[54] BEDDING FOUNDATION FRAME

[75] Inventor: Joe C. Workman, Carthage, Mo.

[73] Assignee: L&P Property Management Company, Chicago, Ill.

[21] Appl. No.: 285,996

[22] Filed: Aug. 4, 1994

[51] Int. Cl.[6] ..... A47C 23/05

[52] U.S. Cl. ..... 5/263; 5/264.1; 5/200.1; 267/100

[58] Field of Search ..... 5/191, 236.1, 263, 5/264.1, 265; 267/100, 103; 108/51.1; 52/376, 377, 730.7

[56] References Cited

U.S. PATENT DOCUMENTS

| | | | |
|---|---|---|---|
| 1,075,845 | 10/1913 | Mills . | |
| 1,909,243 | 5/1933 | Adamy . | |
| 1,977,051 | 10/1934 | Falls . | |
| 3,080,576 | 3/1963 | Cervesi | 5/264.1 |
| 3,717,886 | 2/1973 | Watts . | |
| 3,958,284 | 5/1976 | Jureit | 5/200.1 |
| 4,163,296 | 8/1979 | Kitchen et al. | 5/264.1 |
| 4,399,573 | 8/1983 | Baright . | |
| 4,586,550 | 5/1986 | Kitipornchai . | |
| 4,615,163 | 10/1986 | Curtis et al. . | |
| 4,866,798 | 9/1989 | Harris . | |

*Primary Examiner*—Michael F. Trettel
*Attorney, Agent, or Firm*—Wood, Herron & Evans

[57] ABSTRACT

A bedding foundation frame for use in manufacturing a bedding foundation. The foundation frame includes side rails and end rails formed into a rectangular configuration and a plurality of slats extending between the side rails and parallel to the end rails. Selected ones or all of the slats are reinforced by sheet metal strips positioned in juxtaposition to the bottom of the reinforced slats with a longitudinally extending flange in the central portion of the strip extending upwardly into a longitudinally extending slot in the center of the bottom face of the reinforced slat. These sheet metal strips, because of the presence of the flange in the sheet metal strip, function to provide additional resistance to bending of the slats under normal loads while simultaneously preventing breakage of those slats under abnormal loads.

12 Claims, 4 Drawing Sheets

BEDDING FOUNDATION FRAME

BACKGROUND OF THE INVENTION

This invention relates to bedding foundations, or so-called "box springs" used for supporting bedding mattresses. More particularly, this invention relates to an improved frame for use in such a foundation.

Most bedding manufactured today comprises a mattress and a foundation for supporting the mattress. The function of the foundation is to provide vertical support of the mattress. That foundation may be absolutely rigid as, for example, a wooden frame which has absolutely no flexibility or resiliency, or a block of relatively rigid foam. But in most instances, the foundation provides some resiliency to compliment the resiliency of the mattress. The majority of resilient bedding foundations comprise a wooden base frame upon which there are mounted springs topped by some form of padding and enclosed by some form of upholstered covering. The invention of this application is concerned with an improved base frame for use in such a resilient bedding foundation.

Traditionally, frames of resilient bedding foundations have been manufactured from relatively thin, lightweight wooden rails and slats as in U.S. Pat. No. 4,724,557. But frames have also been made of all metal or with metal slats as in U.S. Pat. No. 3,916,463.

It has also been suggested that bedding foundation frames, or so-called box spring frames, may be improved by reinforcing the relatively thin, lightweight wooden slats of a bedding foundation or box spring with sheet metal. One patent which contains such a disclosure is U.S. Pat. No. 3,717,886 in which there is a disclosure of a flat strip of sheet metal adhered to the underside of a wooden slat or a channel-shaped strip of sheet metal attached thereto to reinforce and strengthen the wooden slat.

Additionally, there is a disclosure contained in U.S. Pat. No. 4,866,798 of attaching reinforcing angle irons to opposite sides of wooden slats so as to reinforce those slats. According to the disclosure of this patent, the angle irons are attached to the wooden slats by nails punched from the angle irons. Bedding foundations having wooden frames reinforced in the manner taught in these latter two patents are excessively heavy and costly. Additionally, manufacturers of such frames requires expensive tooling and fixtures for manufacturing the reinforced frames.

SUMMARY OF THE INVENTION

It has therefore been an objective of this invention to provide an improved bedding foundation and an improved slat for use in such a bedding foundation which improves the firmness and strength of the frame while imparting minimal additional weight and cost to the frame. In fact, the invention of this application may even allow the weight of the frame to be reduced because it enables lesser weight wooden slats to be incorporated into the frame while simultaneously imparting greater strength to the frame.

To achieve these objectives, the invention of this application comprises a bedding foundation having a pair of opposed side rails and opposed end rails formed into a rectangular configuration and a plurality of wooden slats extending between the side rails in spaced parallel relation to the end rails with at least selected ones of the wooden slats being reinforced by sheet metal strips lying in face-to-face juxtaposition with the wooden slats. Each metal strip has a flange upstanding from the central portion of the strip and extending into a slot in the underside of the center of the slat. These metal strips are relatively lightweight and thin gauge, but because of the presence of the flange which is rolled into the sheet metal strips before they are applied to the slats, the strips impart substantial resistance to bending of the slats under normal loading conditions and prevent breakage of those slats under abnormal load conditions.

The primary advantage of frames made in accordance with this invention is that they provide substantial additional strength and resistance to bending of the frame without imparting substantial additional weight or cost to the frame.

These and other objects and advantages of this invention will be more readily apparent from the following description of the drawings, in which.

DETAILED DESCRIPTION OF PREFERRED EMBODIMENT

Figure 1:
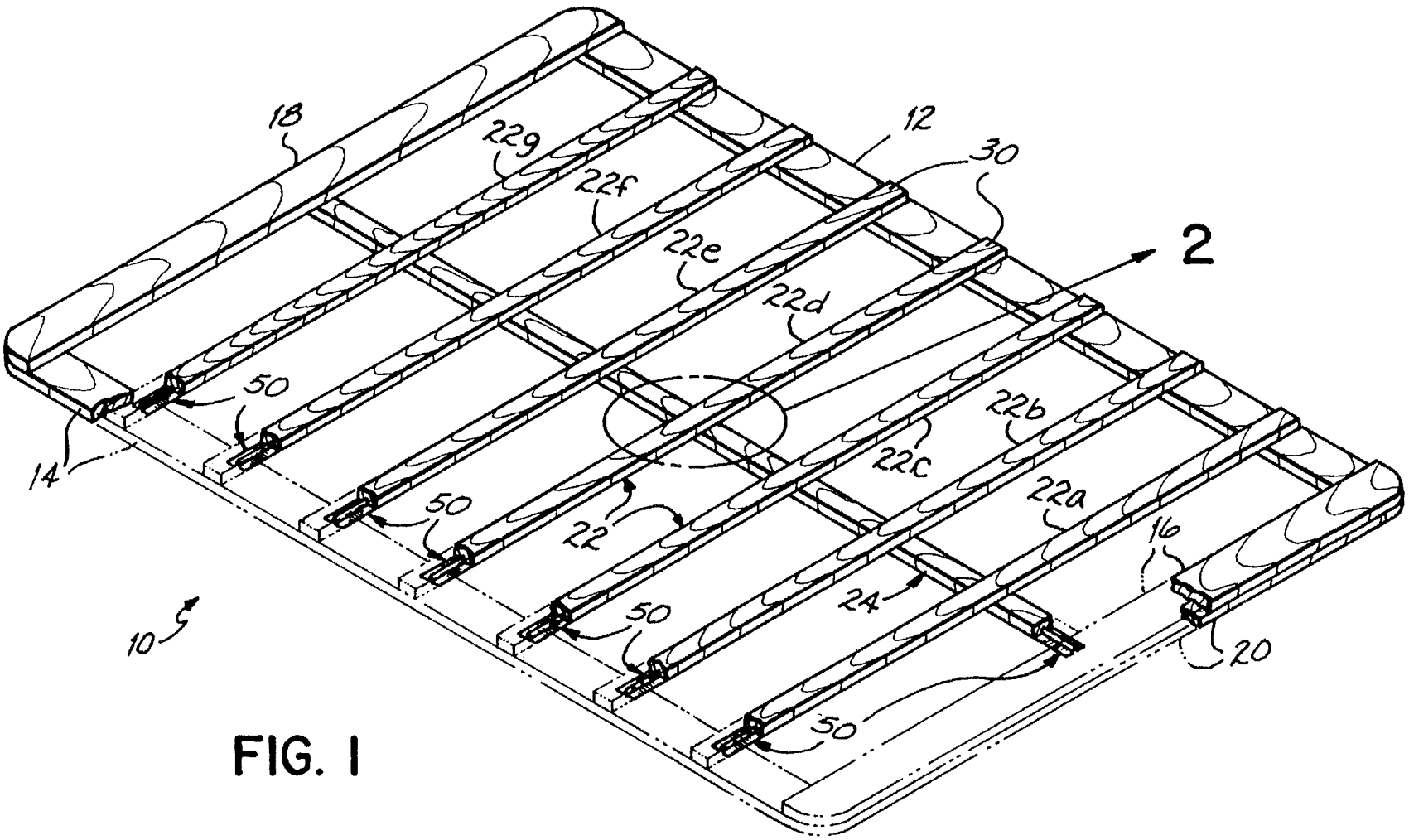
FIG. 1 is a partially broken away perspective view of a frame incorporating the invention of this application.
Figure 2:
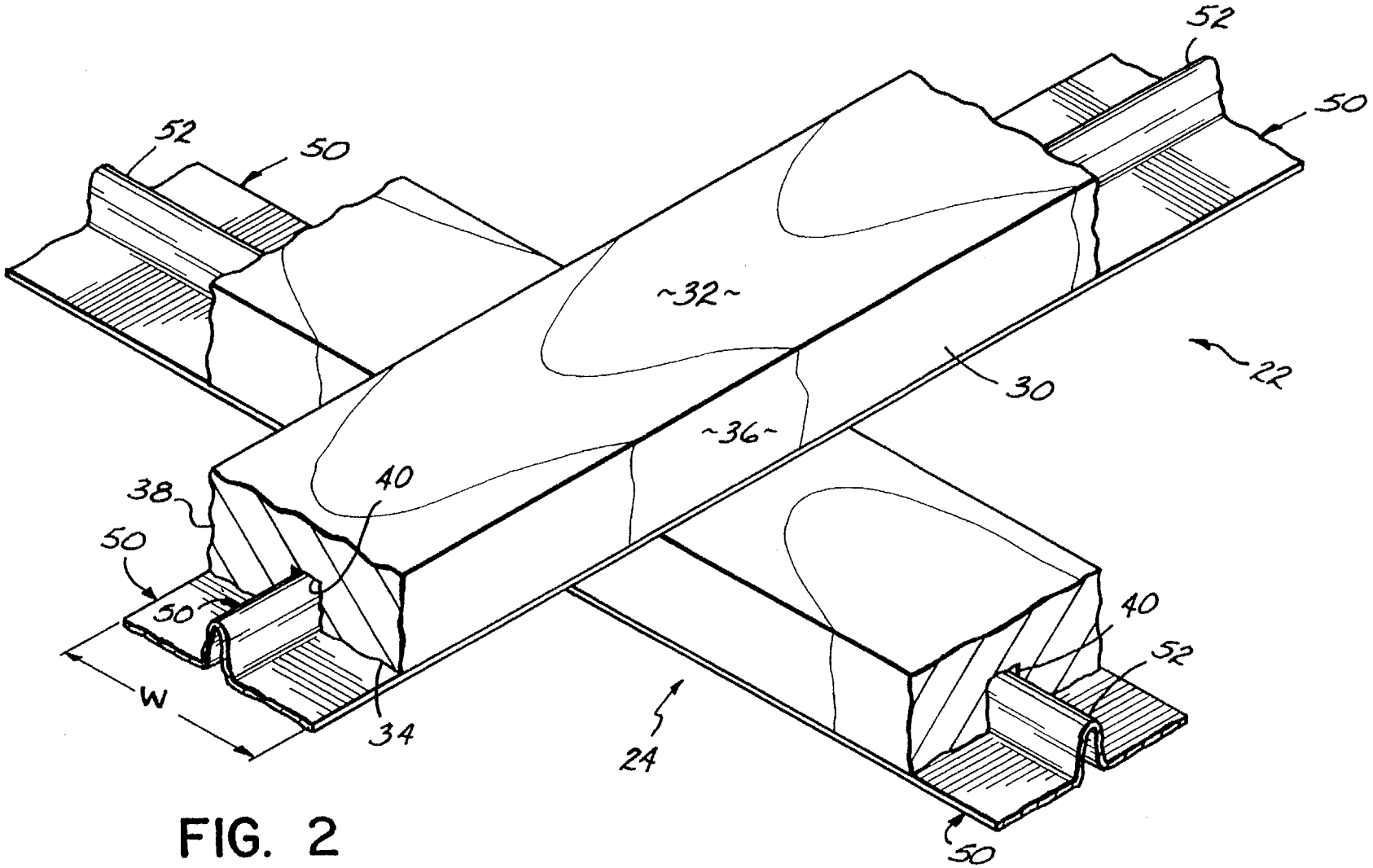
FIG. 2 is an enlarged perspective view of a circled portion of the frame of FIG. 1.

With reference to the drawings, and particularly with reference to FIGS. 1 and 2, it will be seen that the bedding foundation frame 10 of this invention comprises a pair of side rails 12, 14 and a pair of end rails 16, 18 arranged in a rectangular configuration. Additionally, located beneath each end rail 16, 18 there is a spacer 20 which extends between the side rails 12, 14 and has a bottom surface in the same plane as the bottom surface of the side rails 12, 14. Additionally, the frame 10 includes a plurality of transverse slats, the ends of which rest atop and are secured to the side rails 12, 14. The slats may be secured to the side rails by any form of conventional connector, such as conventional nails. But generally, they are secured by nails which extend upwardly from the underside of the side rails into the slats so that there is minimal interference between the nails and any staples or connectors used to secure springs atop the frame.

In the case of king and queen size bedding foundations, there is additionally a longitudinally extending slat 24 which extends for the length of the frame and is secured to the end rails 16, 18 medially of the length of those end rails. In the preferred embodiment, the height of the slat 24 is the same as the height of the spacer 20 secured to the underside of the end rails such that the bottom surface of the longitudinally extending slat 24 is in the same plane as the underside of the spacer 20 and the underside of the side rails 12, 14. It will be noted that the width of the spacer 20 is approximately one-half the width of the end rails 16, 18 such that the ends of the longitudinally extending slat 24 may extend beneath and be secured to the underside of the end rails 16, 18, generally by a nail driven upwardly from the underside of the slat into the underside of the end rails 16, 18.

With particular reference to FIG. 2, it will be seen that each of the slats 22 in this preferred embodiment of the invention comprises a wooden board 30 cut to approximately the same length as the end rails 16, 18, and the slat 24 comprises a wooden board cut to a length which approximates the length of the side rails 12 and 14. Each of these wooden boards 30 has a top planar face 32, a bottom planar face 34, and a pair of side walls 36, 38. The bottom face 34 of each wooden slat 30 is rabbeted medially for the length of the slat so as to form a slot 40 which extends for the full length of the slat on the underside thereof.

Figure 4:
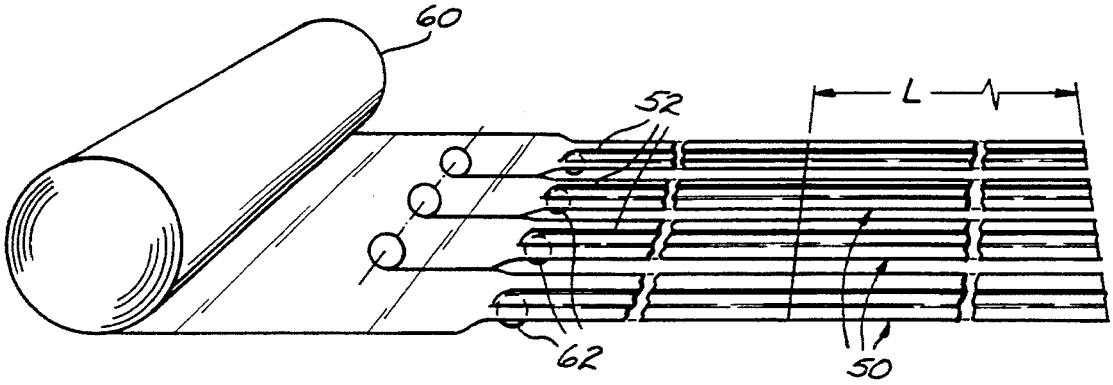
FIG. 4 is a diagrammatic sketch of the process by which the sheet metal strips which reinforces the slats of the foundation are manufactured in accordance with the practice of this invention.

In accordance with the practice of the invention of this application, the wooden slat 30 is reinforced by a sheet metal strip 50. As illustrated in FIG. 4, this strip is formed by being slit from a wide roll 60 of sheet steel approximately 0.034 inches in thickness. This wide roll is initially slit to a width slightly greater than the width of the wooden slat 30. After being slit, the strip of sheet metal is then rolled through a series of rolls 62 in which an upstanding generally V-shaped flange 52 is formed in the strip after which the strip is cut to length L. When cut to length, each strip is of the same length as the length of the slat 22 or 24 which it is to reinforce and approximately the same width W as the wooden slat. When the slat is assembled, the flange 52 of a sheet metal strip is inserted into the slot 40 on the underside of a wooden slat so as to form a completely assembled slat 22 or 24.

In order to assemble a complete frame 10 from the side rails 12, 14, end rails 16, 18, spacers 20, and slats 22, 24, the frame is generally built up in a fixture in which the frame is inverted from the position illustrated in FIG. 1. When so assembled, the end rails 16 and 18 are first placed in a fixture along with the wooden slats 30. Thereafter, the sheet metal strips 50 are placed atop the wooden slats with the flanges 52 of the strips extending downwardly into the slots 40. The spacers 20 are then placed atop the end rails 16, 18. Thereafter, the side rails 12 and 14 are placed atop the ends of the end rails 16, 18. If the frame is a king or queen size foundation frame, the wooden slat of the longitudinally extending slat 24 is then placed atop the sheet metal strips 50 of the slats 22 and atop the end rails 16, 18. Lastly, the sheet metal strip 50 is placed atop the longitudinal slat 24 with the flange 52 of the strip extending downwardly into the slot 40 of the wooden slat. The complete assembly is then nailed together by nails which extend downwardly through the frame. The frame is then removed from the assembly fixture and inverted into the position illustrated in FIG. 1 preparatory to receipt of springs positioned atop the frame.

Figure 3:
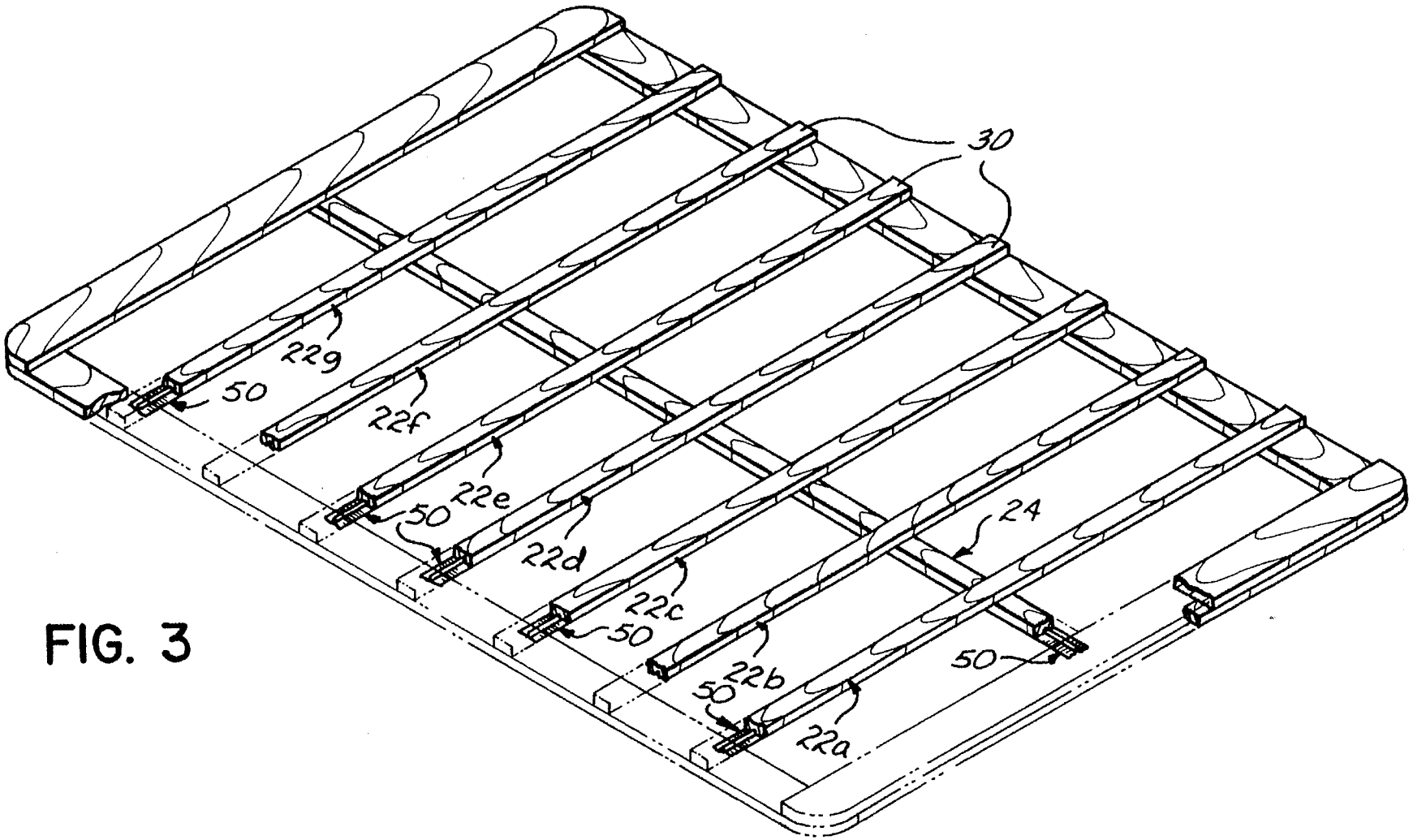
FIG. 3 is a partially broken away perspective view of a second embodiment of this invention.

In the embodiment of FIG. 1, there are seven transverse slats 22*a*–22*g*, each of which is reinforced by a sheet metal strip 50. But not all of the slats need to be reinforced by the sheet metal strips 50 in order to practice the invention of this application. With reference to FIG. 3, it will be seen that the three centermost slats 22*c*, 22*d* and 22*e* are all reinforced by the sheet metal strips as are the two endmost slats 22*a* and 22*g*. But the intermediate slats between the endmost slats and the next adjacent slats are not reinforced. Alternatively, and in some embodiments, only the three centermost slats will be reinforced, or possibly even only the centermost slat 22*d*. The longitudinally extending slat 24 is generally reinforced by the longitudinally extending strip 50 in either the king or queen size foundations. But if the foundation is either standard or twin size, the longitudinally extending slat is omitted.

As yet another alternative to having the longitudinally extending reinforcing strip 50 on the underside of the longitudinally extending slat 24, that slat may be inverted so that the sheet metal reinforcing strip 50 is located between the underside of the transverse slats 22 and the top side of the longitudinally extending slat 24. Or in as yet another alternative, the longitudinally extending reinforcing strip 50 on the underside of the longitudinally extending slat 24 may be positioned beneath the fabric dust cover which conventionally covers the underside of a bedding foundation. Thereby, the reinforcing strip will not only function to reinforce and strengthen the longitudinally extending slat 24, but additionally will function to hold the dust cover in place.

While I have described several different preferred embodiments of my invention, persons skilled in this art will appreciate changes and modifications which may be made without departing from the spirit of my invention. Therefore, I do not intend it to be limited except by the scope of the following appended claims.

I claim:

1. The method of manufacturing a frame for a bedding foundation, which frame comprises a pair of opposed side rails, opposed end rails and a plurality of slats, which method comprises:

forming said side rails and end rails into a rectangular configuration;

cutting a plurality of wooden boards into wooden slats of an appropriate length for spanning between said side rails of said frame, each of said wooden slats having a bottom face, a top face, and opposing side walls of less height than the width of said top and bottom faces;

rabbeting a longitudinally extending slot in the center of one of said top and bottom faces of the wooden slats;

slitting a sheet metal strip to a width slightly greater than the width of the wooden slat;

forming a longitudinally extending flange into the central portion of the sheet metal strip;

cutting the sheet metal strip to the approximate length of the wooden slat;

inserting the flange of the sheet metal strip into the slot of the wooden slat to form a combination wood and sheet metal slat; and attaching the ends of each of said combination wood and sheet metal slats to said side rails of said frame.

2. The method of manufacturing a combination wood and sheet metal bed foundation slat, which method comprises:

cutting a wooden board to an appropriate length for a bed foundation slat, which slat has a bottom face, a top face, and opposing side walls of less height than the width of said top and bottom faces;

rabbeting a slot in the center of one of said top and bottom faces of the wooden slat;

slitting a sheet metal strip to a width slightly greater than the width of the wooden slat;

forming a longitudinally extending flange into the central portion of the sheet metal strip;

cutting the sheet metal strip to the approximate length of the wooden slat; and inserting the flange of the sheet metal strip into the slot of the wooden slat to form a combination wood and sheet metal slat.

3. A combination wood and sheet metal slat for use in a bed foundation, comprising:

an elongated wooden board cut to an appropriate length for forming a bed foundation wooden slat, said wooden slat having a bottom face, a top face, and opposing side walls of less height than the width of said top and bottom faces;

a slot in the center of one of said top and bottom faces of the wooden slat;

a sheet metal strip having a face in surface-to-surface contact with said one of said top and bottom faces of the wooden slat; and a longitudinally extending flange in the central portion of the sheet metal strip extending into the slot of the wooden slat to form a combination wood and sheet metal slat.

4. A frame for a bedding foundation, which frame comprises:

a pair of opposed side rails and a pair of opposed end rails formed into a rectangular configuration;

a plurality of wooden boards spanning between said side rails of said frame, each of said wooden slats having a bottom face, a top face, opposing side walls of less height than the width of said top and bottom faces, and a longitudinally extending slot in the center of one of said top and bottom faces of the wooden slat;

a plurality of sheet metal strips generally conforming in length and width to the length and width of the wooden slats, each of said sheet metal strips having a longitudinally extending flange extending upwardly from the central portion of the sheet metal strip; and each of said sheet metal strips being in juxtaposition to said one of said top and bottom faces of one of said wooden slats with said flange of said strip extending into said slot of said wooden slat, whereby said metal strips provide additional resistance to bending of said wooden slats under normal loads and prevent breakage of said wooden slats under abnormal loads.

5. A frame for a bedding foundation, comprising:

a pair of opposed side rails and a pair of opposed end rails formed into a rectangular configuration;

a plurality of wooden slats extending between said side rails in spaced parallel relation to one another and to said opposed end rails, said wooden slats each having a top face, a bottom face, and opposed side walls of less height than the width of said top and bottom faces;

at least selected ones of said wooden slats each having a longitudinally extending slot in the center of said bottom face;

a plurality of metal strips of a thickness substantially less than the height of said wooden slats and having a normally planar portion, said strips each having an upstanding longitudinal flange formed in the center portion of said strip; and at least said selected ones of said wooden slats being reinforced by planar portions of said strips being in juxtaposition to the bottom faces of respective ones of said wooden slats with the flanges of said strips extending upwardly into the slots of said wooden slats, said wooden slats and said strips together bending when a normal load is placed on said frame, but with the strips providing additional resistance to bending of said wooden slats under normal loads and preventing breakage of said wooden slats under abnormal loads.

6. The frame of claim 5 wherein said planar portions of said strips are in surface-to-surface contact with the bottom faces of said wooden slats.

7. The frame of claim 5 wherein said metal strips are of a length and width corresponding generally to the length and width of said wooden slats.

8. The frame of claim 5 wherein all of said wooden slats of said frame are reinforced by said metal strips.

9. The frame of claim 5 wherein less than all of said wooden slats of said frame are reinforced by said metal strips.

10. The metal frame of claim 5 wherein there is at least one wooden slat extending longitudinally between said end rails, said longitudinally extending wooden slat having a top face, a bottom face, and opposed side walls of less height than the width of said top and bottom faces, said longitudinally extending wooden slat having a longitudinally extending slot in the center of one of said top and bottom faces; and one of said metal strips being in juxtaposition to one of said top and bottom faces of said longitudinally extending wooden slat with the flange of said one of said metal strips extending into the longitudinally extending slot of said longitudinally extending wooden slat.

11. The metal frame of claim 10 wherein said flange of said one of said metal strips extends upwardly into the longitudinally extending slot in the bottom face of said longitudinally extending slat.

12. A frame for a bedding foundation, comprising:

a pair of opposed side rails and a pair of opposed end rails formed into a rectangular configuration;

a plurality of wooden slats extending between said side rails in spaced parallel relation to one another and to said opposed end rails, said wooden slats each having a top face, a bottom face, and opposed side walls of less height than the width of said top and bottom faces;

at least one of said wooden slats having a longitudinally extending slot in the center said bottom face;

a sheet metal strip of a thickness substantially less than the height of said wooden slats having a normally planar portion, said strip having an upstanding longitude flange formed in the center portion of said strip; and said planar portion of said strip being in juxtaposition to the bottom face of said least one of said wooden slats with the flange of said strip extending upwardly into the slot of said at least one of said wooden slats, said at least one of said wooden slats and said strip together bending when a normal load is placed on said frame, but with the strip providing additional resistance to bending of said at least one of said wooden slats under normal loads and preventing breakage of said at least one of said wooden slats under abnormal loads.

* * * * *